US010021495B2

(12) United States Patent
Vonlanthen et al.

(10) Patent No.: US 10,021,495 B2
(45) Date of Patent: Jul. 10, 2018

(54) ANTENNA FOR HEARING DEVICE, EAR TIP AND HEARING DEVICE PROVIDED WITH SUCH AN ANTENNA

(71) Applicant: Sonova AG, Stafa (CH)

(72) Inventors: Andi Vonlanthen, Oberrohrdorf (CH); Stephan Gehring, Uerikon (CH); Christoph Leist, Rapperswil (CH); Andreas Jakob, Hombrechtikon (CH); Daniel Probst, Uerikon (CH)

(73) Assignee: SONOVA AG, Staefa (CH)

( * ) Notice: Subject to any disclaimer, the term of this patent is extended or adjusted under 35 U.S.C. 154(b) by 0 days.

(21) Appl. No.: 15/211,108

(22) Filed: Jul. 15, 2016

(65) Prior Publication Data

US 2016/0330555 A1 Nov. 10, 2016

Related U.S. Application Data

(63) Continuation of application No. 14/385,548, filed as application No. PCT/EP2012/054721 on Mar. 16, 2012, now Pat. No. 9,426,588.

(51) Int. Cl.

| | |
|---|---|
| ***H04R 25/00*** | (2006.01) |
| ***H01Q 1/27*** | (2006.01) |
| ***H01Q 7/00*** | (2006.01) |

(52) U.S. Cl.

CPC ..... *H04R 25/608* (2013.01); *H01Q 1/273* (2013.01); *H01Q 7/00* (2013.01); *H04R 25/554* (2013.01); *H04R 25/652* (2013.01); *H04R 25/552* (2013.01); *H04R 25/654* (2013.01); *H04R 2225/021* (2013.01); *H04R 2225/023* (2013.01);

(Continued)

(58) Field of Classification Search

CPC ..... H04R 25/608

See application file for complete search history.

(56) References Cited

U.S. PATENT DOCUMENTS

| | | | |
|---|---|---|---|
| 5,640,457 | A | 6/1997 | Gnecco |
| 6,473,512 | B1 | 10/2002 | Juneau |
| 8,224,003 | B2 | 7/2012 | Reithinger |

(Continued)

FOREIGN PATENT DOCUMENTS

| | | |
|---|---|---|
| EP | 1 389 891 B1 | 2/2004 |
| EP | 2 053 878 B1 | 4/2009 |

(Continued)

OTHER PUBLICATIONS

International Search Report for PCT/EP2012/054721 dated Nov. 20, 2012.

Written Opinion for PCT/EP2012/054721 dated Nov. 20, 2012.

*Primary Examiner* — Duc Nguyen

*Assistant Examiner* — Phan Le

(74) *Attorney, Agent, or Firm* — Pearne & Gordon LLP

(57) ABSTRACT

An antenna module for a hearing device includes a hollow core provided with an axial passageway and a winding around the core which is connectable with a hearing device. The antenna module is arranged to be at least partially contained within the ear canal of a user. This enables the antenna to be separated from sources of interference, since it can be positioned inside the ear canal away from hearing device electronics, thus reducing requirements for shielding and/or compensation. The invention further relates to an ear tip and a hearing device including such an antenna module.

17 Claims, 3 Drawing Sheets

(52) U.S. Cl.
CPC .... *H04R 2225/025* (2013.01); *H04R 2225/49* (2013.01); *H04R 2225/51* (2013.01)

(56) References Cited

U.S. PATENT DOCUMENTS

| | | | | |
|---|---|---|---|---|
| 2007/0086610 | A1* | 4/2007 | Niederdrank | H01Q 1/273 381/312 |
| 2007/0139284 | A1* | 6/2007 | Victorian | H01Q 1/273 343/718 |
| 2008/0273735 | A1* | 11/2008 | Burson | H04R 1/083 381/363 |
| 2009/0196444 | A1 | 8/2009 | Solum | |
| 2010/0321269 | A1* | 12/2010 | Ishibana | H01Q 1/273 343/834 |
| 2011/0022121 | A1* | 1/2011 | Meskins | A61N 1/37229 607/57 |
| 2011/0249850 | A1* | 10/2011 | Davis | H04R 25/02 381/328 |
| 2014/0153755 | A1* | 6/2014 | Hug | H04R 25/604 381/315 |

FOREIGN PATENT DOCUMENTS

| | | | |
|---|---|---|---|
| EP | 2 088 804 | A1 | 8/2009 |
| WO | 2004/064483 | A2 | 8/2004 |

* cited by examiner

ANTENNA FOR HEARING DEVICE, EAR TIP AND HEARING DEVICE PROVIDED WITH SUCH AN ANTENNA

BACKGROUND OF THE INVENTION

Field of the Invention

The invention relates to the field of hearing devices, such as hearing aids and active hearing protection devices, and more particularly to an antenna module for hearing devices capable of receiving and/or transmitting electromagnetic signals. Furthermore, the invention relates to an ear tip comprising such an antenna module, and a hearing device comprising the same.

Description of the Related Art

Modern hearing devices have become extremely small, particularly in the case of ITE, CRT and CIC-type devices, and often incorporate a plurality of functionalities. For instance, it has become increasingly common for a wireless link to be incorporated in hearing devices, for various purposes such as receiving information, e.g. as electromagnetically encoded sound information from an induction loop; wireless programming of the hearing device; or for establishing a wireless link between two hearing devices, or between one or more hearing devices and a further device.

Conventionally, the antenna is a simple coil antenna wound around a simple cylindrical core made of a highly magnetically permeable material such as ferrite, and incorporated in any convenient position in the hearing device. This presents the disadvantages of taking up significant amounts of space in the hearing device and presenting significant design difficulties. In addition, the coil is often subject to parasitic electromagnetic fields emanating from electrical components in the hearing device, particularly from the receiver. As a result, shielding and/or compensation coils are required, which are bulky and take up a significant amount of space in the hearing device, to eliminate the negative effects of these parasitic electromagnetic fields.

The first of these disadvantages is at least partially overcome in EP 1 389 891 A2 by winding the antenna coil around an existing electro-acoustic transducer in the hearing aid device or around a capsule surrounding the transducer. While this saves space in the hearing device and allows increasing of the diameter of the antenna coil, this arrangement is also subject to undesired electromagnetic interference from the electromagnetic components, particularly those contained within the volume delimited by the antenna coils. As a result, shielding and/or compensation coils are still required. Furthermore, this arrangement prohibits the use of a magnetically permeable core, limiting the gain of the antenna.

The object of the present invention is therefore to overcome at least one of the above-mentioned disadvantages in the prior art, and thereby to provide an antenna module capable of high gain and with a minimised requirement for shielding and/or compensation.

SUMMARY OF THE INVENTION

The above-mentioned object is achieved by the characteristics of the independent claim.

Specifically, this is achieved by an antenna module for a hearing device comprising a hollow core and a winding provided around said core that can be connected with a hearing device. The core can be cylindrical, conical, tapered, funnel-shaped, trumpet shaped, of oval longitudinal cross-section, or any other convenient shape. The core comprises an axial passageway, which can be cylindrical, trumpet-shaped, horn-shaped, conical, tapered, funnel-shaped, or any other convenient shape, and the antenna module is adapted to be at least partially, optionally completely, containable within the ear canal of a user. By configuring the antenna module to be at least partially or completely containeable within the ear canal and with the above-mentioned hollow axial passageway gives at least one of the following advantages:

1. In use, when incorporated into a hearing device, the antenna can be physically separated from interference-causing components in the hearing device by situating the antenna deep in the ear canal away from the electronics of the hearing device, thus reducing and/or completely eliminating the necessity for shielding and/or compensation coils. This simplifies the construction of the hearing device, and enables the hearing device to be made smaller than at present, and thereby produces cost savings in manufacture.

2. The size of a hearing device with wireless function can be reduced, due to the reduction/elimination of shielding and/or compensation, and as a result of moving the antenna away from the circuitry and/or out of the shell of the hearing device and into normally unused space in the ear canal.

3. Particularly in the case of CIC's (although it equally applies to BTE and ITE-types) with wireless link, the ability to position the antenna modules at least partially in the ear canal improves the wireless link between the two hearing devices by permitting positioning of the antennas closer together than is possible with current solutions, to the tune of 30-40 mm when the antenna module is situated deeply inserted into the ear canal. This optimises the antenna positioning for this application. In addition, it should be noted that with current wireless technologies working at high frequencies, e.g. of the order of 2.4 GHz, a hole in the core of the antenna has no negative effect on the antenna's gain.

4. Due to the axial passageway in the core, sound can travel through the core rather than having to be guided around it by a tube as it would in the case of a conventional solid cylindrical core if arranged to be disposed at least partially within the ear canal. This enables greater design freedom of acoustical tubing. Indeed, the core itself may form part of the acoustical tubing, i.e. the sound-guiding pathway from the receiver to the user's ear.

Although the antenna module is arranged to be containable within the ear canal of a user, it does not necessarily have to be: it simply is of a size such that placing it in the ear canal is possible. It could, for instance, be incorporated into the hook of a BTE hearing device housing, or in a BTE hearing device housing itself, either in substitution for a conventional antenna, or advantageously utilising the hollow passageway through the core either as part of the sound pathway or so as a pathway for a sound tube and/or wire tube. In this case, the antenna can be placed at an extremity of the BTE housing or in the hook, moving it away from the circuitry, saving space in the housing, and reducing the shielding requirements as described above.

In an embodiment, at least one tube is connected with the axial passageway through the core. This enables sound to be guided to and through the antenna module, and enables the optimisation of the acoustic or parameters of the sound tube, such as length, diameter, and shape.

In an embodiment, a tube passes through the axial passageway in the core. This enables a particularly sturdy construction of the antenna module giving enhanced longevity of the antenna module.

In an embodiment, the tube is arranged in a least one extremity of the axial passageway, giving flexibility in design. In the case when this one tube is arranged between the hollow core and the receiver, a trumpet-shaped or horn-shaped passageway is particularly advantageous since it will improve the acoustic properties of the sound passageway.

In an embodiment, a tube is arranged in each extremity of the axial passageway, enabling further flexibility in design.

In an embodiment, the tube is arranged to be connected with the sound output of a receiver unit, so as to channel sound from the receiver unit through the antenna module to the user. This is the case for any of the possible tube arrangements.

Furthermore, the invention concerns an ear tip for a hearing device comprising such an antenna module as described above, enabling integration of the antenna module into an ear tip.

In an embodiment the ear tip comprises a shell, and the antenna module is arranged inside or outside of said shell, giving flexibility in design of the ear tip.

In an embodiment, in the case where the antenna module is arranged inside of the shell of an ear tip or of a hearing device, the shell has a seat for the antenna module conformed so as to hold and support the antenna module. This results in a particularly robust construction.

Furthermore, the antenna module can be bonded into the seat in the shell, for example by glueing, further strengthening the construction.

Furthermore, the invention concerns a hearing device comprising an antenna module or an ear tip as described above, enabling integration of the antenna module or the ear tip into a hearing device.

In an embodiment, the hearing device may be of the Behind-The-Ear-type, or of the In-The-Ear-type, or of the Canal-Receiver-Technology-type or of the Completely-In-the-Canal-type.

In an embodiment, the hearing device may further comprise a wax guard, for protecting the interior of the hearing device from cerumen emanating from the wearer's ear. The present arrangement with a hollow antenna enables a simple, rotationally-symmetrical construction of the wax guard in comparison with a conventional, solid-core antenna arranged next to a tube, which requires a complicated wax guard shape to fit around the solid antenna.

It should be noted that, under a hearing device, a device is understood, which is worn in or adjacent to an individual's ear with the object to improve the individual's acoustical perception. Such improvement may also be barring acoustic signals from being perceived in the sense of hearing protection for the individual in addition to a normal hearing aid. With respect to the application area, a hearing device may be applied behind the ear (BTE), in the ear (ITE), completely in the ear canal (CIC), or as an implantable device such as a cochlea implant.

BRIEF DESCRIPTION OF THE DRAWINGS

Exemplary embodiments will be described with reference to the following figures.

DETAILED DESCRIPTION OF THE PREFERRED EMBODIMENTS

Figure 1:
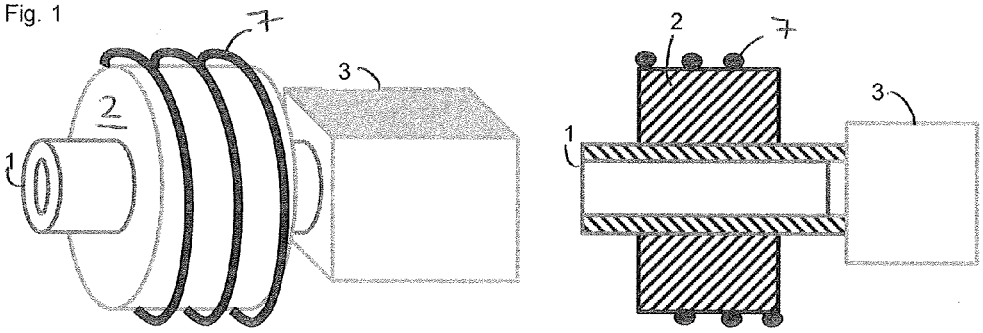
FIG. 1 shows a perspective and a sectional view of an antenna module according to a first embodiment of the invention, coupled with a receiver.

FIG. 1 illustrates an antenna module according to a first embodiment of the invention. This antenna module comprises a core 2 formed substantially as a hollow cylinder, i.e. a cylinder with an axial passageway. Although a hollow cylindrical core is illustrated in the figures with a cylindrical axial passageway, many other shapes are foreseen as falling within the scope of the current invention. The core can be cylindrical, conical, tapered, funnel-shaped, trumpet shaped, of oval longitudinal cross-section, or any other convenient shape. The axial passageway can be cylindrical, trumpet-shaped, horn-shaped, conical, tapered,-funnel-shaped, or any other convenient shape. The shape of the passageway can thereby be conformed so as to tailor the acoustic properties of the overall sound passageway. The core may be constructed of a magnetically permeable material, such as ferrite, or may be constructed of a non-magnetic material such as plastic. Around the core 2 is an electrically-conductive winding 7 in the form of a helical coil. Through the passageway in the core 2 passes a tubing 1 which channels the acoustic output of the receiver 3 with which it is connected. The receiver can be of any type, such as those standard in the art described in section 2.6 of "*Hearing Aids*" by Harvey Dillon, Boomerang Press, Australia, 2001, and need not be described further. The winding 7 is electrically connected with the signal processing unit of the associated hearing device (not illustrated).

Figure 2:
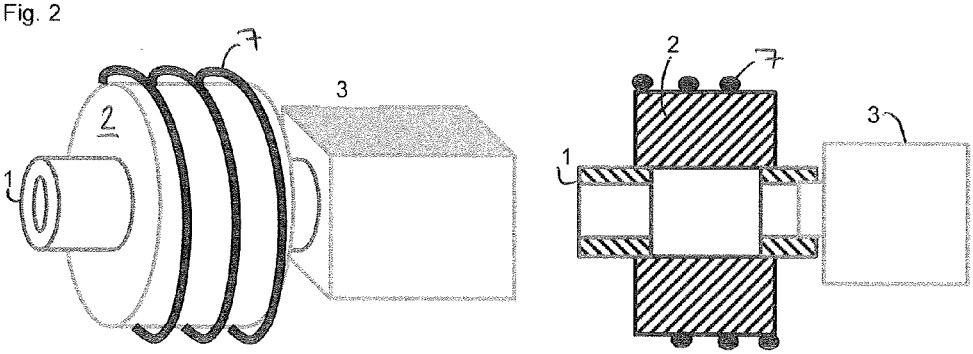
FIG. 2 shows a perspective and a sectional view of an antenna module according to a second embodiment of the invention, coupled with a receiver.

FIG. 2 illustrates an antenna module according to a second embodiment of the invention. The core 2 and the winding 7 are substantially identical to those in FIG. 1, however two pieces of tubing 1 are provided, one in each end of the axial passageway in the core 2. One of these sections of tubing is connected with the acoustic output of the receiver 3, and the other, in use, will transmit the acoustic output to the user. It should be noted that in this embodiment the passageway through the core 2 itself forms part of the acoustic pathway from the receiver 3 to the user.

Figure 3:
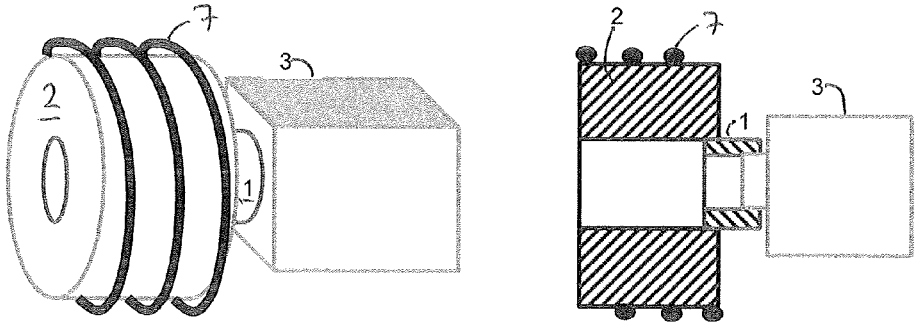
FIG. 3 shows a perspective and a sectional view of an antenna module according to a third embodiment of the invention, coupled with a receiver.

FIG. 3 illustrates an antenna module according to a third embodiment of the invention, which differs from that of FIG. 2 only in that a single, short piece of tube 1 is used to connect the passageway through the core 2 to the receiver 3. In this embodiment, the majority of the acoustic pathway from the receiver 3 to the user is constituted by the passageway through the core 2.

Figure 4:
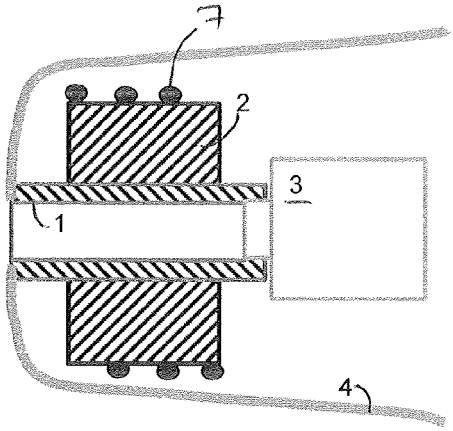
FIG. 4 shows a sectional view of a part of a hearing device incorporating an antenna module according to the first embodiment and a receiver within its shell.

FIG. 4 illustrates the antenna module according to the first embodiment of the invention integrated into the shell 4 of an ear tip or a hearing device. A shell may be customised to fit a particular wearer or may by a standard shape. Although the antenna module according to the first embodiment is illustrated here, it is evident that any of the other embodiments could be substituted in its place.

Figure 5:
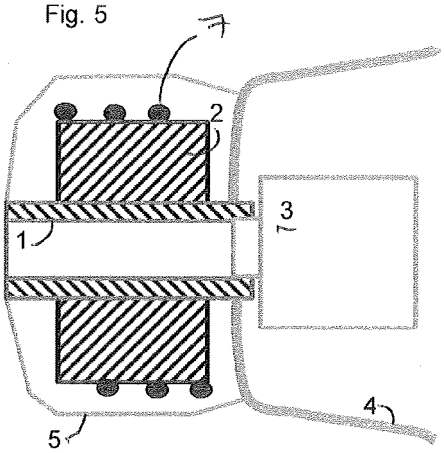
FIG. 5 shows a sectional view of a part of a hearing device incorporating a receiver inside its shell and antenna module according to the first embodiment situated outside of said shell.

FIG. 5 illustrates the antenna module according to the first embodiment of the invention integrated into an ear tip or a hearing device comprising a shell 4 but situated outside of the custom shell 4. In this case, the antenna module is surrounded by a soft material, for instance soft rubber. One particular advantage of this arrangement is that the antenna module can be easily replaced if required without having to open the shell 4, for instance if the hole through the antenna and/or the tube 1, becomes blocked by cerumen. Although the antenna module according to the first embodiment is illustrated here, it is evident that any of the other embodiments could be substituted in its place.

Figure 6:
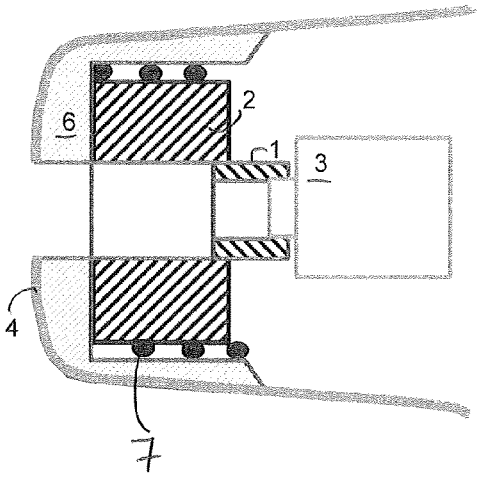
FIG. 6 shows a sectional view of a part of a hearing device incorporating an antenna module according to the third embodiment and a receiver inside its shell.

FIG. 6 illustrates the antenna module of the third embodiment integrated into the custom shell 4 of an ear tip or a hearing device, wherein the antenna module is fixed to the shell, e.g. by glueing. The shell for example comprises a seat 6 for the antenna module configured so as to optimally support and position the antenna module. This results in a particularly robust construction. This construction is particularly well-suited to a horn-shaped passageway in the core instead of the illustrated cylindrical passageway. Although the antenna module according to the third embodiment is illustrated here, it is evident that any of the other embodiments could be substituted in its place.

Figure 7:
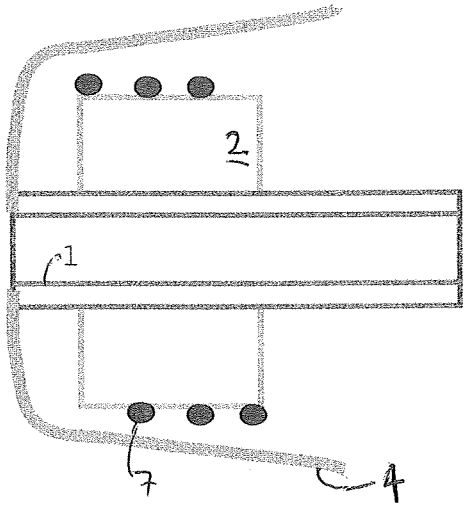
FIG. 7 shows a sectional view of part of an ear tip for a Behind-The-Ear hearing aid incorporating an antenna module according to the first embodiment.

FIG. 7 illustrates the antenna module of the first embodiment integrated into the custom shell 4 of an ear tip for a BTE application. This differs from the arrangement of FIGS. 4-6 in that the receiver can be positioned at any convenient location, conventionally in a BTE module, and connected by a tube to the antenna module.

Having thus described the present invention in sufficient detail to enable those skilled in the art to make and use the invention, it nevertheless should be appreciated that the illustrated embodiments may be varied in many ways without departing from the scope of the present invention as defined by the appended claims. For instance, the core of the antenna module could be constituted by a flexible or rigid acoustic tube rather than by a separate core, i.e. winding 7 could be wound directly around tube 1.

Alternatively, the core 2 as illustrated in the figures could be connected directly to the audio output of the receiver 3. In addition, the antenna module according to the invention, although suitable for positioning at least partially inside the ear canal, could be positioned conventionally within a BTE shell, or utilising the hollow passageway through the core either as part of the sound pathway or so as a pathway for a sound tube and/or wire tube in a BTE hook or a BTE shell.

The invention claimed is:

1. Antenna module for a hearing device comprising a hollow core, a sound tube arranged in the hollow core, and a winding provided around said core and connectable with said hearing device, wherein said core comprises a hollow passageway and said antenna module is adapted to utilize said hollow passageway through said core as a pathway for the sound tube, wherein said winding is an electrically conductive antenna in the form of a helical coil and is electrically connected to a signal processing unit of the hearing device, wherein said sound tube is arranged to be connected with a sound output of a receiver unit, and wherein said winding is wound directly around said sound tube.

2. Antenna module according to claim 1, wherein the hearing device is a behind-the-ear-type hearing device.

3. Antenna module according to claim 1, wherein said tube is connected with said passageway.

4. Antenna module according to claim 3, wherein said tube passes through said hollow passageway.

5. Antenna module according to claim 1, wherein said tube is arranged in at least one extremity of said hollow passageway.

6. Antenna module according to claim 5, wherein a tube is arranged in each extremity of said hollow passageway.

7. Antenna module according to claim 1, wherein said core is constituted by a flexible or rigid acoustic tube.

8. Antenna module according to claim 7, wherein said core is arranged to be connected directly with the sound output of a receiver unit.

9. Antenna module according to claim 2, wherein said antenna module is adapted to be incorporated into a hook of the behind-the-ear-type hearing device.

10. Antenna module according to claim 2, wherein said antenna module is adapted to be incorporated into a housing of the behind-the-ear-type hearing device.

11. Antenna module according to claim 10, wherein said antenna module is adapted to be incorporated into the housing of the behind-the-ear-type hearing device at an extremity of the housing.

12. Ear tip for a behind-the-ear-type hearing device comprising an antenna module according to claim 1.

13. Hearing device comprising an antenna module according to claim 1.

14. Hearing device according to claim 13, wherein said hearing device comprises a shell, and wherein said shell comprises a seat located on the inside of said shell and conformed to support said antenna module, and wherein said antenna module is supported by said seat.

15. Hearing device according to claim 14, wherein said antenna module is bonded to said seat.

16. Hearing device according to claim 15, wherein said antenna module is bonded to said seat by means of glue.

17. Hearing device according to claim 13, further comprising a wax guard.

* * * * *